US005947438A

United States Patent [19]

Lemire

[11] Patent Number: 5,947,438

[45] Date of Patent: Sep. 7, 1999

[54] PICTURE FRAME HANGER HAVING VERTICAL AND HORIZONTAL ADJUSTABILITY

[76] Inventor: Robert Lemire, P.O. Box 299, Kings Park, N.Y. 11754

[21] Appl. No.: 09/022,836

[22] Filed: Feb. 12, 1998

[51] Int. Cl.[6] ..... A47G 1/24

[52] U.S. Cl. ..... 248/476; 248/495

[58] Field of Search ..... 248/476, 480, 248/485, 486, 487, 489, 493, 495

[56] References Cited

U.S. PATENT DOCUMENTS

| | | | |
|---|---|---|---|
| 351,673 | 10/1886 | Vosburgh | 248/493 |
| 2,983,473 | 5/1961 | Waller et al. | 248/495 |
| 3,241,796 | 3/1966 | Asher et al. | 248/495 X |
| 3,251,569 | 5/1966 | Rynearson | 248/493 |
| 4,566,665 | 1/1986 | Rynearson | 248/493 X |

*Primary Examiner*—Ramon O. Ramirez

[57] ABSTRACT

The present invention is a simple 'U' channel cross section which has a plurality of threaded adjusters extending from one side of the channel to the other. The threaded adjuster further has an adjusting nut which is adapted to receive a picture hanging wire or cord. A preselected set of configurations provides for a picture hanger which provides horizontal, and vertical movement in one or several devices. The present invention is adaptable to include large pictures and small.

8 Claims, 6 Drawing Sheets

PICTURE FRAME HANGER HAVING VERTICAL AND HORIZONTAL ADJUSTABILITY

BACKGROUND OF THE INVENTION

1. Field of the Invention

The present invention relates to picture hanging devices. More particularly, the present invention relates to adjustable picture hanging devices.

2. Description of the Prior Art

Pictures hanging from a wall typically are supported from a hanger by a wire hanging wire which is attached at opposite ends to the frame. This method, though simple lacks a feature to keep a picture level. Consequently, the picture owner must frequently adjust the frame to bring it back to level. Professional offices and Museums require the pictures to remain straight and hold considerable more load than the home user. While one method is to secure the picture to the wall with a fastening device, this lacks the flexibility of replacement of the picture. What is needed is a simple, secure yet adjustable device for hanging a variety of pictures that prevents the frames from rotating.

Numerous innovations for a picture frame hanger have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a simple 'C' channel cross section which has a plurality of threaded adjusters extending from one side of the channel to the other. The threaded adjuster further has an adjusting nut which is adapted to receive a picture hanging wire or cord. A preselected set of configurations provides for a picture hanger which provides horizontal, and vertical movement in one or several devices. The present invention is adaptable to include large pictures and small.

The types of problems encountered in the prior art are that pictures hung from a single or double support tend to not be at the desired location on the wall.

In the prior art, unsuccessful attempts to solve this problem were attempted namely: single supports in conjunction with a wire and double hangers using a single wire. In both cases the wire is permitted to slide through the hangers. However, the problem was solved by the present invention because the wire is securely attached to the hanger and can only be moved by adjusting the threaded adjuster.

The present invention went contrary to the teaching of the art which permits the wire to slide on the hanger, by securing the wire to the hanging device and providing an adjustment device.

The present invention solved a long felt need for a simple secure way of preventing picture from tilting.

Accordingly, it is an object of the present invention to provide secure non-tilting hanging of pictures.

More particularly, it is an object of the present invention to provide a device which is adjustable permitting a picture to be leveled and positioned horizontally and vertically.

In keeping with these objects, and with others which will become apparent hereinafter, one feature of the present invention resides, briefly stated, in a first housing which may be fastened to a mounting surface or the picture frame.

In accordance with another feature of the present invention, a wire is securely attached at one end to the housing.

Another feature of the present invention is that a threaded adjuster having an adjustable nut is provided to adjust the length of the wire so that the picture can be up to the desired level position.

Yet another feature of the present invention is that the weight of the wire causes tension around the adjustable nuts which prevent the wire from slipping.

Still another feature of the present invention is that a wire is attached to a picture frame at both ends and intertwined through the present invention to permit both vertical and horizontal adjustment.

Yet still another feature of the present invention is that a plurality of the present invention in cooperation with a picture provides adjustment in vertical and horizontal.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

COMMON COMPONENTS TO EMBODIMENTS

12A—fastener (12A)
14A—threaded adjuster (14A)
14AA—first threaded adjuster cord holder (14AA)
14ABA—first threaded adjuster outer nut (14ABA)
14ABB—first threaded adjuster inner nut (14ABB)
14B—second fastener (14B)
14BA—second threaded fastener cord holder (14BA)
16—picture frame (16)
16T—picture frame top (16T)
6B—picture frame bottom (16B)
16L—picture frame left side (16L)
16R—picture frame right side (16R)

FIRST EMBODIMENT

110—first picture frame hanger (110)
112—first housing (112)
112A—first housing backing (112A)
112O—first housing outer lip (112O)
112OA—first housing outer lip first opening (112OA)
112OB—first housing outer lip second opening (112OB)
112I—first housing inner lip (112I)
112IA—first housing inner lip first opening (112IA)
112IB—first housing inner lip second opening (112IB)
112IC—first housing inner lip third opening (112IC)
112ID—first housing inner lip fourth opening (112ID)
112IE—first housing inner lip fifth opening (112IE)
116—first cord (116)
116A—first cord knot (116A)
116B—first cord end (116B)
118—first clip (118)

SECOND EMBODIMENT

210—second picture frame hanger (210)
212L—second left clip (212L)
212R—second right clip (212R)

214—second cord (214)
214A—second cord first knot (214A)
214B—second cord second knot (214B)

THIRD EMBODIMENT

310—third picture frame hanger (310)
312—third housing (312)
312A—third housing backing (312A)
312O—third housing outer lip (312O)
312OA—third housing outer lip first opening (312OA)
312OB—third housing outer lip second opening (312OB)
312I—third housing inner lip (312I)
312IA—third housing inner lip first opening (312IA)
312IB—third housing inner lip second opening (312IB)
312IC—third housing inner lip third opening (312IC)
312ID—third housing inner lip fourth opening (312ID)
312M—third housing middle lip (312M)
312MA—third housing middle lip opening (312MA)
314—third cord (314)
314A—third cord first end (314A)
314B—third cord second end (314B)
316—third fastener (316)

FOURTH EMBODIMENT

410—fourth picture frame hanger (410)
412—fourth bracket (412)
412T—fourth bracket top (412T)
412B—fourth bracket back (412B)
412L—fourth bracket left side (412L)
412R—fourth bracket right side (412R)
412A—fourth bracket bottom (412A)

FIFTH EMBODIMENT

510—fifth picture frame hanger (510)
512—fifth bracket (512)
512A—fifth bracket plate (512A)
512L—fifth bracket left hook (512L)
512R—fifth bracket right hook (512R)
514—fifth cord (514)
514A—fifth cord knot (514A)

SIXTH EMBODIMENT

610—sixth picture frame hanger (610)
612—sixth bracket (612)
612A—sixth bracket plate (612A)
612LO—sixth left outer eyelet (612LO)
612LI—sixth left inner eyelet (612LI)
612RO—sixth right outer eyelet (612RO)
612RI—sixth right inner eyelet (612RI)
614L—sixth left adjuster (614L)
614LA—sixth left adjuster holder (614LA)
614R—sixth right adjuster (614R)
614RA—sixth right adjuster holder (614RA)

DESCRIPTION OF THE PREFERRED EMBODIMENT

Figure 1:
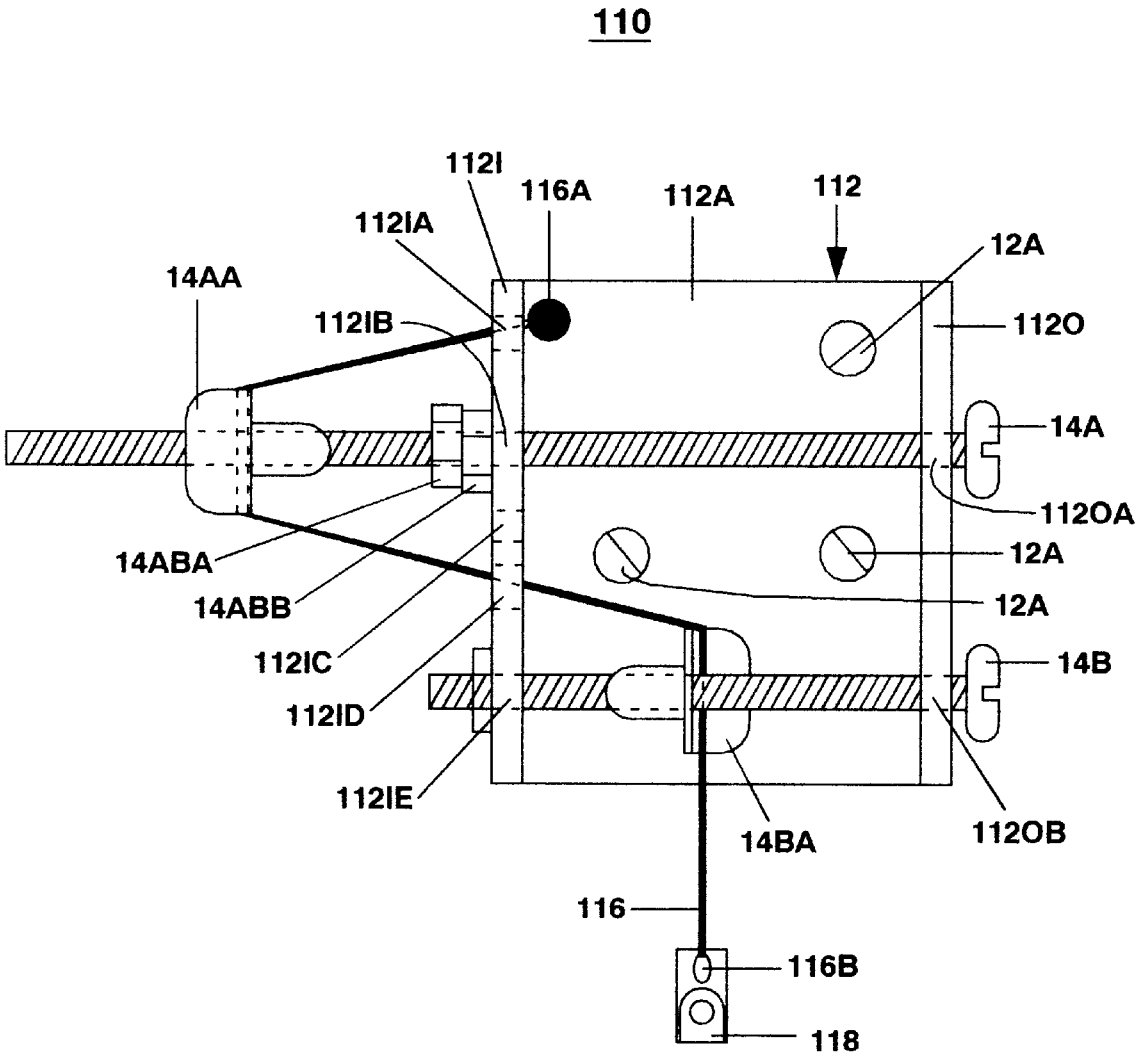
FIG. 1 is a front view of a first picture frame hanger.

Firstly, referring to FIG. 1 which is a front view of a first picture frame hanger (110). The first picture frame hanger (110) comprises a first housing (112). The first housing (112) comprises a first housing backing (112A) having a first housing outer lip (112O) disposed along an edge extending outwardly therefrom and a first housing inner lip (112I) disposed along an opposite edge extending outwardly therefrom The first housing outer lip (112O) comprises a first housing outer lip first opening (112OA) and a first housing outer lip second opening (112OB) therethrough. The first housing inner lip (112I) comprises a first housing inner lip first opening (112IA) and a first housing inner lip second opening (112IB) and a first housing inner lip third opening (112IC) and a first housing inner lip fourth opening (112ID) and a first housing inner lip fifth opening (112IE) therethrough. The first housing backing (112A) is mountable to a wall by at least one fastener (12A).

The first picture frame hanger (110) further comprises a first threaded adjuster (14A). The first threaded adjuster (14A) is positioned through the first housing outer lip first opening (112OA) and the first housing inner lip second opening (112IB). The first threaded adjuster (14A) comprises a first threaded adjuster cord holder (14AA) engagably mounted on an end of the first threaded adjuster (14A) outside the first housing inner lip (112I). At least one threaded adjuster outer nut is engagably mounted on the first threaded adjuster (14A) on an outside the first housing inner lip (112I) adjacent thereto. The first threaded adjuster outer nut comprises a first threaded adjuster outer nut (14ABA) and a first threaded adjuster inner nut (14ABB).

The first picture frame hanger (110) further comprises a second threaded adjuster (14B) is positioned through the second housing outer lip second opening (112OB) and the second housing inner lip fifth opening (112IE). The second threaded adjuster (14B) comprises a second threaded adjuster cord holder (14BA) engagably mounted on an end of the second threaded adjuster (14B) between the second housing inner lip (112I) and the first housing outer lip (112O).

The first picture frame hanger (110) further comprises a first cord (116) comprises a first cord knot (116A) positioned on an inside of the first housing inner lip (112I). The first cord (116) passes through the first housing inner lip first opening (112IA) then around the first threaded adjuster cord holder (14AA), through the first housing inner lip fourth opening (112ID), and around the second threaded fastener cord holder (14BA). A first clip (118) is attached to a first cord end (116B). When a user turns the threaded adjuster (14A) clockwise the first clip (118) which is attached to a hanging wire of a picture frame (16) is lowered. When the user turns the threaded adjuster (14A) counterclockwise the first clip (118) which is attached to the hanging wire of a picture frame (16) is raised. When a user turns the threaded adjuster (14B) clockwise the first clip (118) which is attached to a hanging wire of a frame (16) moves horizontally toward the first housing outer lip second opening (112OB) and is raised. When a user turns the threaded adjuster (14B) counter clockwise the first clip (118) which is attached to a hanging wire of a picture frame (16) moves horizontally toward the first housing inner lip fifth opening (112IE) and is lowered. The combined action of the threaded adjuster (14A) and the threaded adjuster (14B) functions to position the picture frame (16) in a vertical and horizontal direction.

The first picture frame hanger (110) is manufactured from a material selected from a group consisting of plastic, plastic composite, metal, metal alloy, wood, fiberglass, epoxy, carbon-graphite, rubber and rubber composite.

Figure 2:
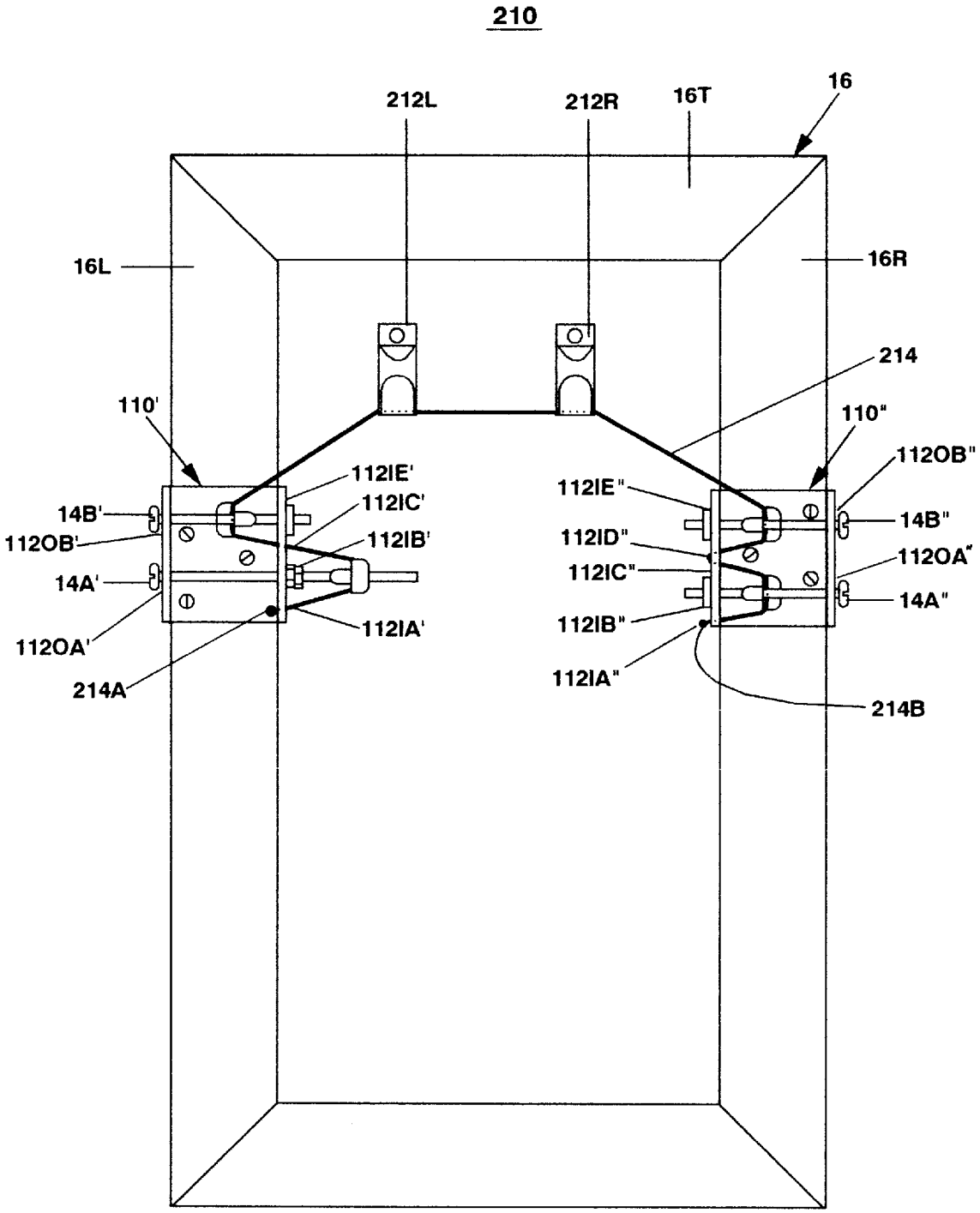
FIG. 2 is a rear view of a second picture frame hanger showing a picture frame exhibiting a first picture frame hanger securely mounted on a picture frame left side and a picture frame right side. The second left clip and the second right clip are wall mountable.

Secondly, referring to FIG. 2 which is a rear view of a second picture frame hanger (210) showing a picture frame (16) exhibiting a first picture frame hanger (110) securely mounted on a picture frame left side (16L) and a picture frame right side (16R). A second picture frame hanger (210) comprises a primary first picture frame hanger (110) securely attached to a picture frame left side (16L). The first picture frame hanger (110) comprises a first housing (112). The first housing (112) comprises a first housing backing (112A) having a first housing outer lip (112O) disposed along an edge extending outwardly therefrom and a first housing inner lip (112I) disposed along an opposite edge extending outwardly therefrom. The first housing outer lip (112O) comprises a first housing outer lip first opening (112OA) and a first housing outer lip second opening (112OB) therethrough. The first housing inner lip (112I) comprises a first housing inner lip first opening (112IA) and a first housing inner lip second opening (112IB) and a first housing inner lip third opening (112IC) and a first housing inner lip fourth opening (112ID) and a first housing inner lip fifth opening (112IE) therethrough.

The first picture frame hanger (110) is mounted upside down onto the picture frame left side (16L) and further comprises a first threaded adjuster (14A) is positioned through the first housing outer lip first opening (112OA) and the first housing inner lip second opening (112IB). The first threaded adjuster (14A) comprises a first threaded adjuster cord holder (14AA) engagably mounted on an end of the first threaded adjuster (14A) outside the first housing inner lip (112I). At least one threaded adjuster outer nut is engagably mounted on the first threaded adjuster (14A) on an outside of the first housing inner lip (112I) and adjacent thereto. The first threaded adjuster outer nut comprises a first threaded adjuster outer nut (14ABA) and a first threaded adjuster inner nut (14ABB).

The first picture frame hanger (110) further comprises a first threaded adjuster (14B) which is positioned through the first housing outer lip second opening (112OB) and the first housing inner lip fifth opening (112IE). The first threaded adjuster (14B) comprises a first threaded adjuster cord holder (14BA) which is engagably mounted on an end of the first threaded adjuster (14B) between the second housing inner lip (112I) and the first housing outer lip (112O).

The second picture frame hanger (210) further comprises a secondary first picture frame hanger (110)securely attached to a picture frame right side (16R). The secondary picture hanger (110) is mounted upside down onto the picture frame right side (16R) of the picture frame (16) and further comprises a threaded adjuster (14A) which is positioned through the second housing outer lip first opening (112OA) and the second housing inner lip second opening (112IB). The threaded adjuster (14A) comprises a first threaded adjuster cord holder (14AA) engagably mounted on an end of the threaded adjuster (14A) between the second housing inner lip (112I) and the first housing outer lip (112O). The second picture frame hanger (210) further comprises a second threaded adjuster (14B) which is positioned through the second housing outer hp second opening (112OB) and the second housing inner lip fifth opening (112EE). The second threaded adjuster (14B) comprises a second threaded fastener cord holder (14BA) which is engageably mounted on an end of the second fastener (14B) between the second housing inner lip (112I) and the second housing outer lip (112O).

The second picture frame hanger (210) further comprises at least one second clip (212L, 212R) securely mounted on a wall.

The second picture frame hanger (210) further comprises a second cord (214).

The second cord (214) comprises a second cord first knot (214A) positioned on an inside of the first housing inner lip (112I). The second cord (214) passes through the first housing inner lip first opening (112IA), around the first threaded adjuster cord holder (14AA), through the first housing inner hp fourth opening (112ID), and around the second threaded fastener cord holder (14BA) of the primary first picture frame hanger (110). The second cord (214) further comprises a second cord second knot (214B) positioned on an outside of the first housing inner lip (112I). The second cord (214) passes through the first housing inner hp first opening (112IA), around the first threaded adjuster cord holder (14AA), out through the first housing inner lip third opening (112IC), and in through the first housing inner lip fourth opening (112ID), around the second threaded fastener cord holder (14BA) of the primary first picture frame hanger (110). When a user turns the threaded adjuster (14A) and the second fastener (14B) of the primary first picture frame hanger (110) clockwise the picture frame (16) is lowered and moves its level center to a right. When the user turns the threaded adjuster (14A) and the second fastener (14B) counterclockwise the picture frame (16) is raised and moves its level center to a left. When a user turns the threaded adjuster (14A) and the second fastener (14B) of the secondary first picture frame hanger (110) clockwise the picture frame (16) is raised and moves its level center to a left. When the user turns the threaded adjuster (14A) and the second fastener (14B) counterclockwise the first clip (118) the picture frame (16) is lowered and moves its level center to a right.

Figure 3:
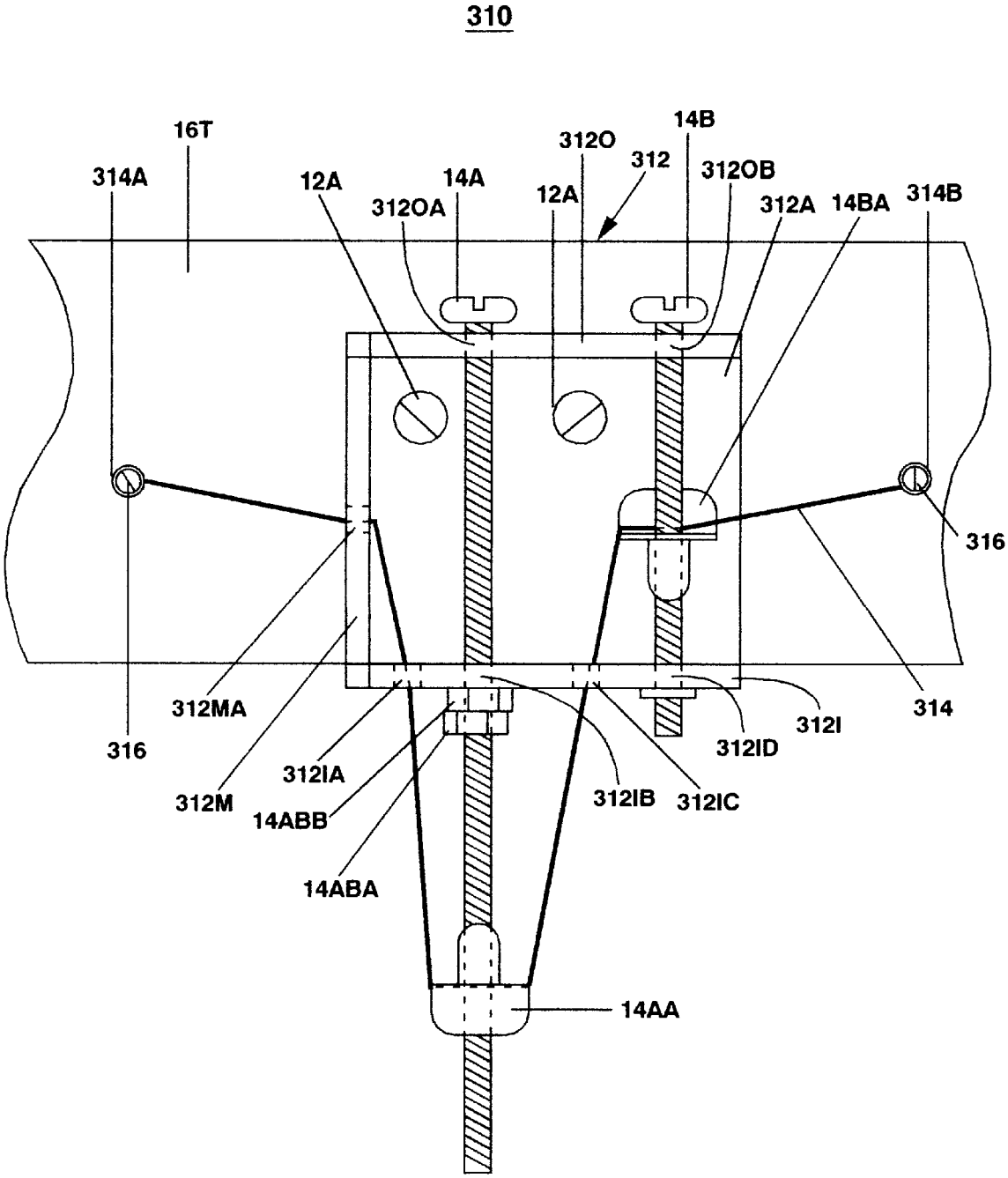
FIG. 3 is a rear view of a third picture frame hanger. The third cord first end and the third cord second end are securely attached to the picture frame top.

Fourthly, referring to FIG. 3 is a rear view of a third picture frame hanger (310). The third cord first end (314A) and the third cord second end (314B) are securely attached to the picture frame top (16T). A third picture frame hanger (310) comprises a third housing (312). The third housing (312) comprises a third housing backing (312A) having a third housing outer lip (312O) disposed along an edge extending outwardly therefrom and a third housing inner lip (312I) disposed along an opposite edge extending outwardly therefrom and a third housing middle lip (312M) disposed along a middle edge extending outwardly therefrom The third housing outer lip (312O) comprises a third housing outer lip first opening (312OA) and a third housing outer lip second opening (312OB) therethrough. The third housing inner lip (312I) comprises a third housing inner lip first opening (312IA) and a third housing inner lip second opening (312IB) and a third housing inner lip third opening (312IC) and a third housing inner lip fourth opening (312ID) therethrough. The third housing middle lip (312M) comprises a third housing middle lip opening (312MA) therethrough. The third housing backing (312A) is mountable to a wall by at least one fastener (12A);

The third picture frame hanger (310) further comprises a first threaded adjuster (14A) is positioned through the third housing outer lip first opening (312OA) and the third housing inner lip second opening (312IB). The first threaded adjuster (14A) comprises a first threaded adjuster cord holder (14AA) engagably mounted on an end of the first threaded adjuster (14A) outside the third housing inner lip (312I). At least one threaded adjuster outer nut (14ABA) engagably mounted on the first threaded adjuster (14A) on an outside the third housing inner lip (312I) adjacent thereto.

The third picture frame hanger (310) further comprises a second threaded adjuster (14B) which is positioned through the third housing outer lip second opening (312OB) and the third housing inner lip fourth opening (312ID). The second threaded adjuster (14B) comprises a second threaded adjuster cord holder (14BA) engagably mounted on an end of the second threaded adjuster (14B) between the third housing outer lip (312O) and the third housing inner lip (312I).

The third picture frame hanger (310) further comprises a third cord (314). The third cord (314) comprises a third cord first end (314A) and a third cord second end (314B) each securely attached to a picture frame top (16T) by a third fastener (316). The third cord (314) passes through the third housing middle hp opening (312MA), 11 the third housing inner lip first opening (312IA) around the first threaded adjuster cord holder (14AA) through the third housing inner lip third opening (312IC) around the second threaded fastener cord holder (14BA). When a user turns the threaded adjuster (14A) clockwise the picture frame (16) is lowered. When the user turns the threaded adjuster (14A) counterclockwise the picture frame (16) is raised. Turning the second fastener (14B) clockwise raises the position of the third cord (314) on second threaded fastener cord holder (14BA) and tilts the picture frame (16) below horizontal. Turning the second fastener (14B) counterclockwise lowers the position of the third cord (314) on the second threaded fastener cord holder (14BA) and tilts the picture frame (16) above horizontal. When the tension on the third cord (314) is removed the third cord (314) is easily slid through the third picture frame hanger (310) to align the picture frame (16) to a preselected horizontal orientation. The further turning of the threaded adjuster (14A) and the second fastener (14B) together raises and levels the picture frame (16).

The third picture frame hanger (310) is manufactured from a material selected from a group consisting of plastic, plastic composite, metal, metal alloy, wood, fiberglass, epoxy, carbon-graphite, rubber and rubber composite.

Figure 4:
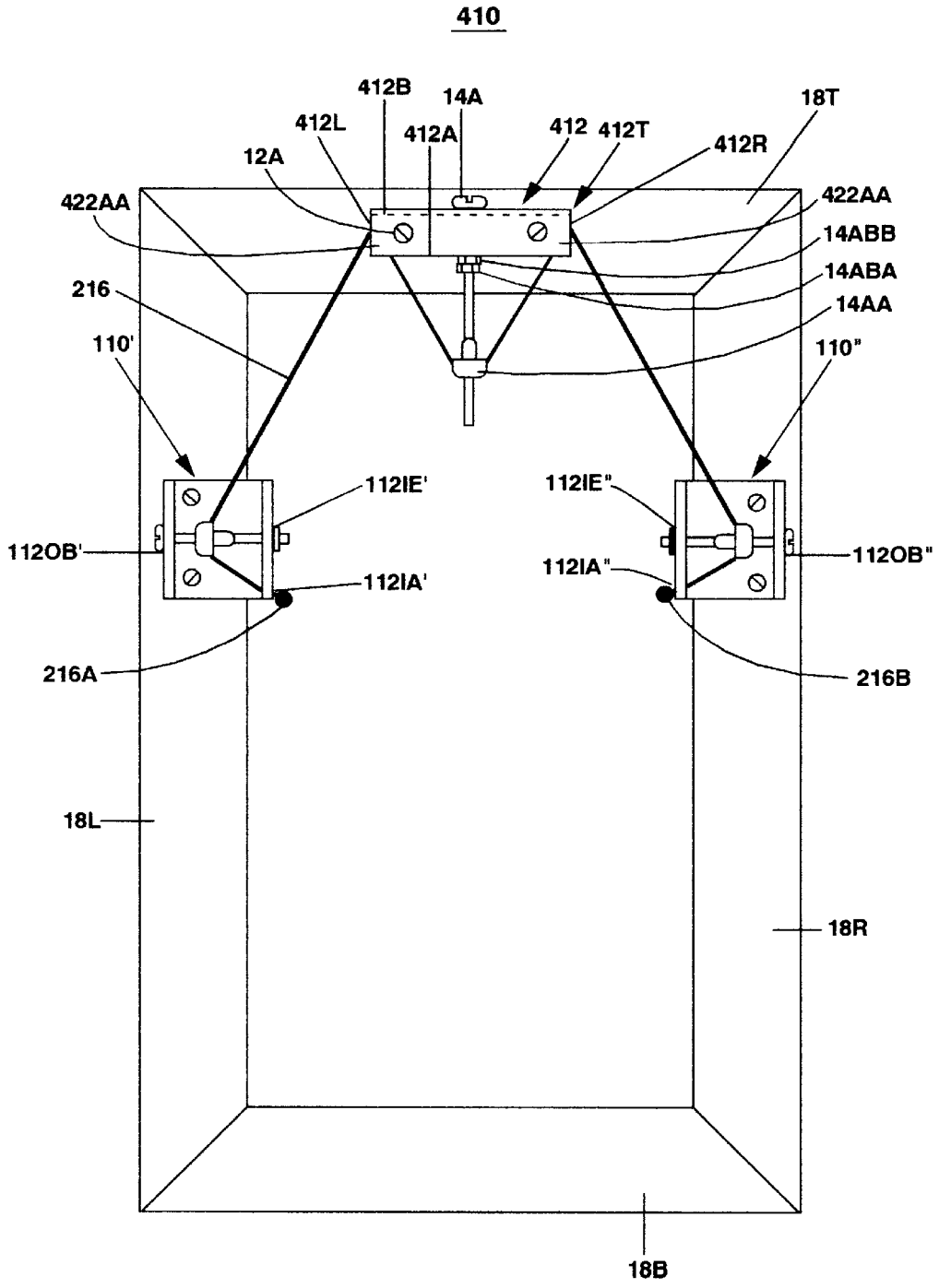
FIG. 4 is a rear view of a fourth picture frame hanger showing a first picture frame hanger securely attached to a picture frame left side and a first picture frame hanger securely attached to a picture frame right side. The fourth bracket is wall mountable.

Fourthly, referring to FIG. 4 which is a rear view of a fourth picture frame hanger (410) showing a first picture frame hanger (110) securely attached to a picture frame left side (16L) and a first picture frame hanger (110) securely attached to a picture frame right side (16R). The fourth bracket (412) is wall mountable.

The first picture frame hanger (110) comprises a first housing (112). The first housing (112) comprises a first housing backing (112A) having a first housing outer lip (112O) disposed along an edge extending outwardly therefrom and a first housing inner lip (112I) disposed along an opposite edge extending outwardly therefrom. The first housing outer lip (112O) comprises a first housing outer lip second opening (112OB) therethrough. The first housing inner lip (112I) comprises a first housing inner lip first opening (112IA) and a first housing inner lip fifth opening (112IE) therethrough.

The first picture frame hanger (110) further comprises a second threaded adjuster (14B) which is positioned through the first housing outer lip second opening (112OB) and the first housing inner lip fifth opening (112IE). The second threaded adjuster (14B) comprises a second threaded adjuster cord holder (14BA) engagably mounted between the first housing outer lip (112O) and the first housing inner lip (112I).

The first picture frame hanger (110) further comprises a secondary first picture frame hanger (110)securely attached to a picture frame right side (16R).

The fourth picture frame hanger (410) further comprises a fourth bracket (412) securely mounted on a wall. The fourth bracket (412) comprises a fourth bracket top (412T) having an opening therethrough. The fourth bracket (412) further comprises a fourth bracket back (412B). The fourth bracket (412) further comprises a fourth bracket left side (412L) having an opening therethrough, a fourth bracket right side (412R) having an opening therethrough, and a fourth bracket bottom (412A) having an opening therethrough. The fourth bracket (412) further comprises a threaded adjuster (14A) positioned through the fourth bracket top (412T) opening and the fourth bracket bottom (412A) opening. A first threaded adjuster cord holder (14AA) is engagably mounted on an end of the threaded adjuster (14A) below the fourth bracket bottom (412A). At least one first threaded adjuster nut is engagably positioned between the first threaded adjuster cord holder (14AA) and the fourth bracket bottom (412A). The first threaded adjuster nut comprises a first threaded adjuster outer nut (14ABA) and a first threaded adjuster inner nut (14ABB).

The fourth picture frame hanger (410) further comprises a second cord (216), a second cord first knot (216A) positioned on an outside of the first housing inner lip (112I). The second cord (216) passes through the first housing inner lip first opening (112IA) around the first threaded adjuster cord holder (14AA) through the fourth bracket left side (412L) opening over the first threaded adjuster cord holder (14AA) through the fourth bracket right side (412R) opening over the first threaded adjuster cord holder (14AA) through the first housing inner lip first opening (112IA) terminating in a second cord second knot (216B). When a user turns the threaded adjuster (14A) of the primary first picture frame hanger (110) clockwise the first threaded adjuster cord holder (14AA) moves to the left and the picture frame (16) moves to a upwardly to the right. When the user turns the threaded adjuster (14B) of the primary first picture frame hanger (110) counterclockwise the picture frame (16) is lowered and moves to a left. When the user turns the threaded adjuster (14B) of the secondary first picture frame hanger (110) clockwise the first threaded adjuster cord holder (14BA) moves to the right the picture frame (16) moves to a upwardly to the left. When the user turns the threaded adjuster (14B) of the secondary first picture frame hanger (110) counterclockwise the threaded adjuster cord holder (14BA) moves to the left and the picture frame (16) moves downwardly and to the right. When the user turns the threaded adjuster (14A) of the fourth bracket (412) clockwise the first threaded adjuster cord holder (14AA) moves upwardly and the picture frame (16) is lowered. When the user turns the threaded adjuster (14A) of the fourth bracket (412) counterclockwise the first threaded adjuster cord holder (14AA) moves downwardly and the picture frame (16) is raised. The combined action of the first picture frame hanger (110) and the fourth bracket (412) functions to provide horizontal and vertical positioning of the picture frame (16).

The fourth picture frame hanger (410) is manufactured from a material selected from a group consisting of plastic, plastic composite, metal, metal alloy, wood, fiberglass, epoxy, carbon-graphite, rubber and rubber composite.

Figure 5:
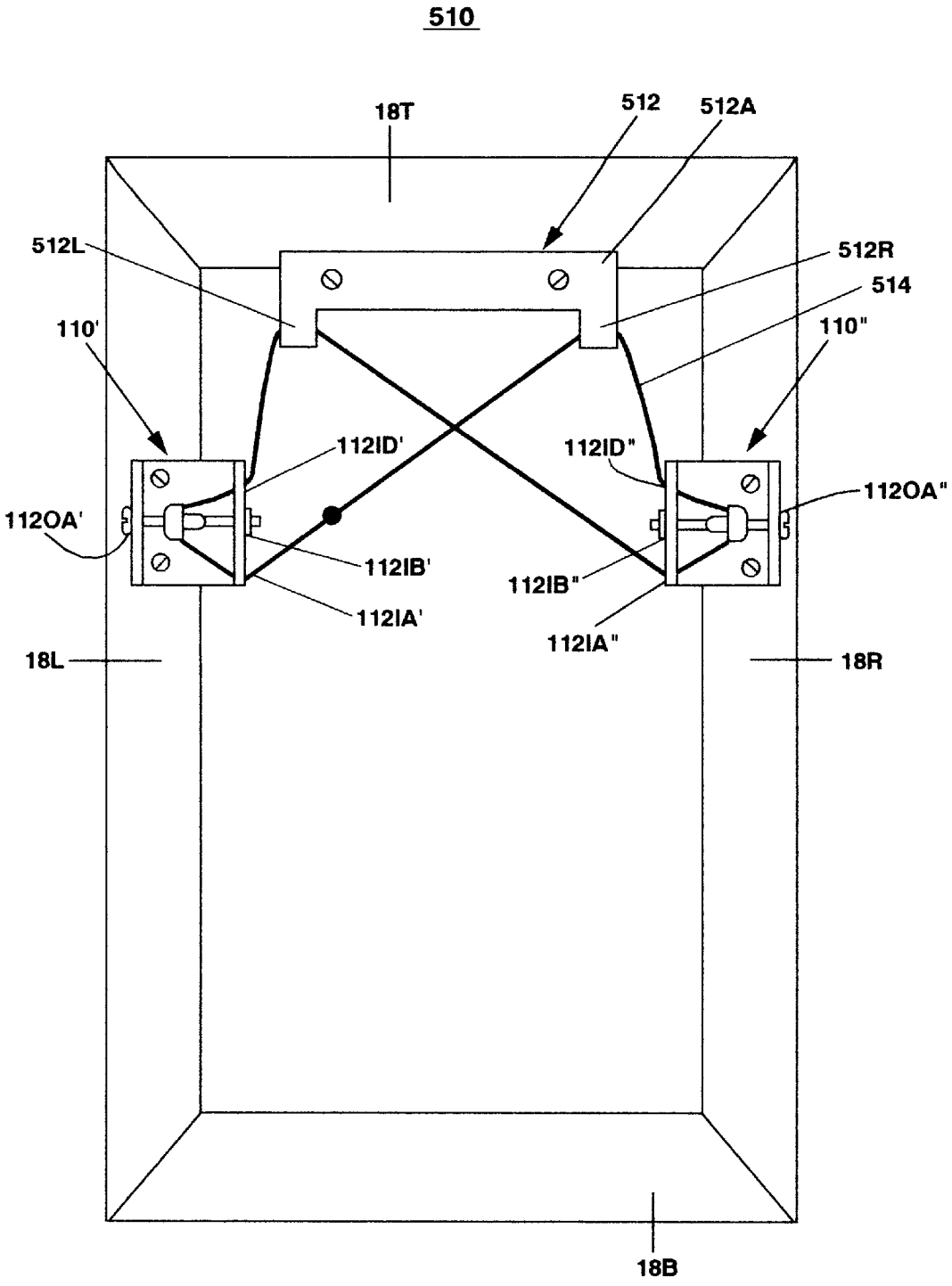
FIG. 5 is a rear view of a fifth picture frame hanger showing a first picture frame hanger securely attached to a picture frame left side and a first picture frame hanger securely attached to a picture frame right side and a fifth bracket that is wall mountable.

Next referring to FIG. 5 which is a rear view of a fifth picture frame hanger (510) showing a first picture frame hanger (110) securely attached to a picture frame left side (16L) and a first picture frame hanger (110) securely attached to a picture frame right side (16R). The fifth bracket (512) is wall mountable. A fifth picture frame hanger (510) comprises a primary first picture frame hanger (110) securely attached to a picture frame left side (16L).

The first picture frame hanger (110) comprises a first housing (112) which comprises a first housing backing (112A) having a first housing outer lip (112O) disposed along an edge extending outwardly therefrom and a first housing inner lip (112I) disposed along an opposite edge extending outwardly therefrom. The first housing outer lip (112O) comprises a first housing outer lip first opening (112OA) therethrough. The first housing inner lip (112I) comprises a first housing inner lip first opening (112IA), and a first housing inner lip second opening (112IB), and a first housing inner lip fourth opening (112ID), therethrough.

The first picture frame hanger (110) further comprises a first threaded adjuster (14A) is positioned through the first housing outer hp first opening (112OA) and the first housing inner lip second opening (112IB). The first threaded adjuster (14A) comprises a first threaded adjuster cord holder (14AA) engagably mounted between the first housing outer lip (112O) and the first housing inner lip (112I).

The first picture frame hanger (110) further comprises a secondary first picture frame hanger (110) which is securely attached to a picture frame right side (16R).

The fifth picture frame hanger (510) further comprises a fifth bracket (512) securely mounted on a wall. The fifth bracket (512) comprises a fifth bracket plate (512A) having a fifth bracket left hook (512L) and a fifth bracket right hook (512R) extending therefrom.

The fifth picture frame hanger (510) further comprises a looped fifth cord (514) which is a continuous loop. The looped fifth cord (514) passes through the first housing inner lip first opening (112IA) of the primary first picture frame hanger (110) around the first threaded adjuster cord holder (14AA) through the first housing inner lip fourth opening (112ID), over the fifth bracket left hook (512L) through the secondary first housing inner lip first opening (112IA) of the secondary first picture frame hanger (110) around the first threaded adjuster cord holder (14AA) through the secondary first housing inner lip fourth opening (112ID) and over the fifth bracket right hook (512R).

When a user turns the threaded adjuster (14A) of the primary first picture frame hanger (110) clockwise the first threaded adjuster cord holder (14AA) moves to the left and the picture frame (16) moves upward. When the user turns the threaded adjuster (14A) of the primary first picture frame hanger (110) counterclockwise first threaded adjuster cord holder (14AA) moves right and the picture frame (16) moves downward. When the user turns the threaded adjuster (14A) of the secondary first picture frame hanger (110) clockwise the first threaded adjuster cord holder (14AA) moves left and the picture frame (16) moves upward. When the user turns the threaded adjuster (14A) of the secondary first picture frame hanger (110) counterclockwise the first threaded adjuster cord holder (14AA) moves left and the picture frame (16) moves downward. The double looped fifth cord (514) in conjunction with the fifth bracket left hook (512L) and the fifth bracket right hook (512R) function to provide side to side adjustability of the picture frame (16).

The fifth picture frame hanger (510) is manufactured from a material selected from a group consisting of plastic, plastic composite, metal, metal alloy, wood, fiberglass, epoxy, carbon-graphite, rubber and rubber composite.

Figure 6:
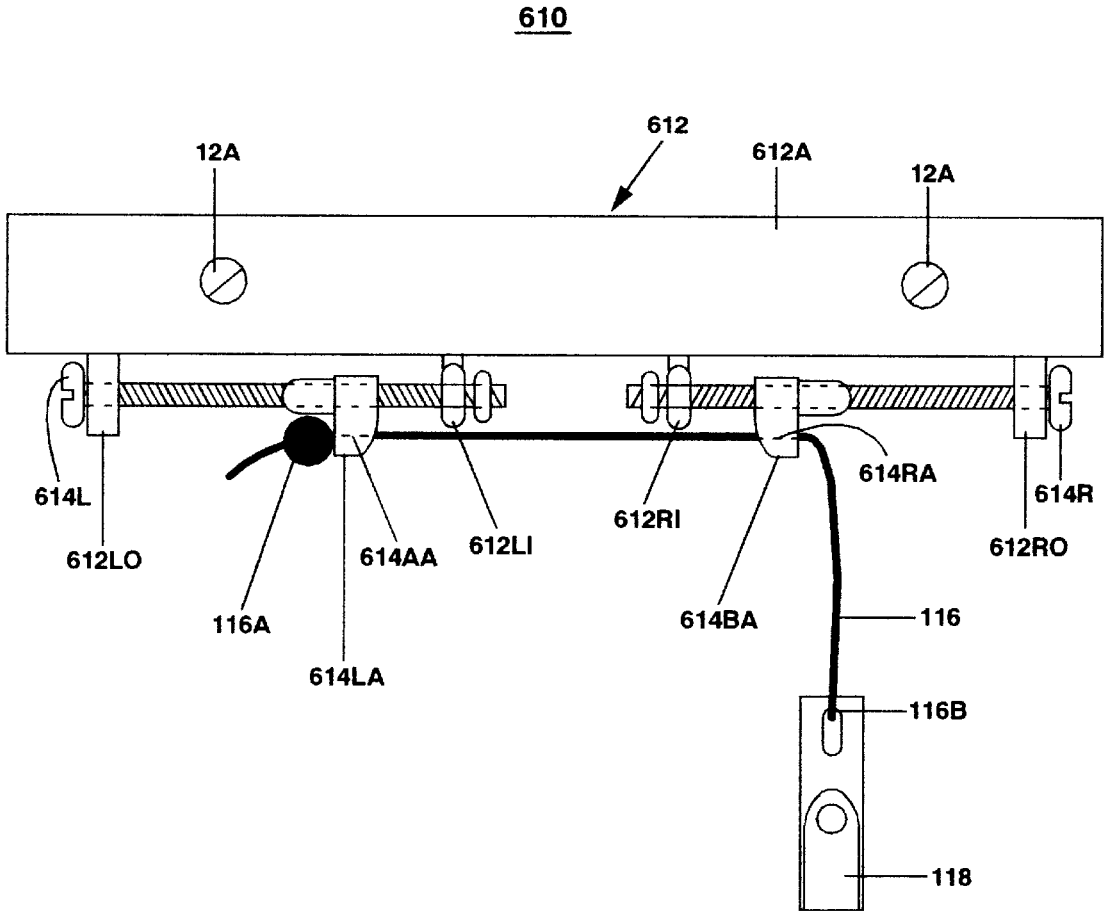
FIG. 6 is a front view of a sixth picture frame hanger (610). The sixth bracket (612) is wall mountable and the first clip (118) is attached to a standard picture frame or picture frame wire.

Lastly, referring to FIG. 6 which is a front view of a sixth picture frame hanger (610). The sixth bracket (612) is wall mountable and the first clip (118) attaches to a standard picture frame. A sixth picture frame hanger (610) comprises a sixth bracket (612) which comprises a sixth bracket plate (612A). The sixth bracket (612) further comprises a sixth left outer eyelet (612LO) and a sixth left inner eyelet (612LI) and a sixth right outer eyelet (612RO) and a sixth right inner eyelet (612RI) extending downwardly therefrom.

The sixth picture frame hanger (610) further comprises a sixth left adjuster (614L) which is positioned through the sixth left outer eyelet (612LO) and the sixth left inner eyelet (612LI). The sixth left adjuster (614L) comprises a sixth left adjuster holder (614LA) having an opening therethrough engagably mounted thereon between the sixth left outer eyelet (612LO) and the sixth left inner eyelet (612LI).

The sixth picture frame hanger (610) further comprises a sixth right adjuster (614R). The sixth right adjuster (614R) is positioned through the sixth right outer eyelet (612RO) and the sixth right inner eyelet (612RI). The sixth right adjuster (614R) comprises a sixth right adjuster holder (614RA) having an opening therethrough engagably mounted thereon between the sixth right outer eyelet (612RO) and the sixth right inner eyelet (612RI).

The sixth picture frame hanger (610) further comprises a first cord (116). The first cord (116) comprises a first cord knot (116A) which is positioned on the outside of the sixth left adjuster holder (614LA). The first cord (116) passes through the sixth left adjuster holder (614LA), through the sixth right adjuster holder (614RA) and a first clip (118) attached at a first cord end (116B). When a user turns the sixth left adjuster (614L) in a clockwise direction, the first clip (118) engages a hanging wire of a picture frame which moves upwardly. When the user turns the sixth left adjuster (614L) in a counter clockwise direction, the first clip (118) moves downwardly. When the user turns the sixth right adjuster (614R) in a clockwise direction, the first clip (118) moves upwardly and to the right. When the user turns the sixth right adjuster (614R) in a counter clockwise direction, the first clip (118) moves downwardly and leftwardly.

A sixth picture frame hanger (610) is manufactured from a material selected from a group consisting of plastic, plastic composite, metal, metal alloy, wood, fiberglass, epoxy, carbon-graphite, rubber and rubber composite.

It will be understood that each of the elements described above, or two or more together, may also find a useful application in other types of constructions differing from the type described above.

While the invention has been illustrated and described as embodied in a picture frame hanger, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A wall mount support assembly for pictures, mirrors, and other similar objects, comprising:

a. a support body adapted to be affixed to a wall, said support body comprising two vertical side lips and open top and bottom edges, b. a cord affixed to said support body on a first end, exiting the bottom edge of said support body, and having a picture hook affixed at a second end, c. adjusting means for changing the horizontal position of the cord where it exits the bottom edge of the support body, and d. adjusting means for changing the vertical position of the second end of the cord, wherein a picture hung on the hook affixed to the second end of the cord may be adjustably positioned in the horizontal and vertical directions.

2. The support assembly of claim 1 wherein the means for changing the horizontal position where the cord exits the bottom edge of the support body comprises:

a. a bottom screw extending through a first pair of the apertures on the vertical side lips, said bottom screw being held in place by a locked nut, b. a threaded first hook engaged on said bottom screw configured to slide against the support body to move horizontally between the two side vertical lips of the support body, and to receive the cord in sliding engagement, wherein turning the bottom screw changes the horizontal position where the cord exits the bottom edge of the support body.

3. The support assembly of claim 2 wherein the means for changing the length of the cord exiting the bottom edge of the support body comprises:

a. a top screw extending through and beyond a second pair of apertures on the vertical side lips, said top screw being held in place by locked nuts, b. a threaded second hook engaged on the section of the top screw extending beyond the support body, and c. the cord affixed to the support body at a fixed position above the top screw, extending from said fixed position to the second hook and from the second hook to the first hook, wherein turning the top screw changes the position of the second hook along the top screw, thereby moving the picture hook with respect to the bottom edge of the support body.

4. The device of claim 3 wherein the top and bottom screws are at the same level and are on opposite ends of the support body and having the cord affixed to the second hook.

5. The device of claim 1 wherein the assembly is adapted to be affixed to the picture frame and the cord exiting the assembly is adapted to be affixed to the wall.

6. A frame mounted cord adjusting assembly for hanging pictures, mirrors, and other similar objects onto wall hooks, comprising:

a. a first support body adapted to be affixed to a first side of a picture frame, b. a second support body adapted to be affixed to a second side of a picture frame, c. a cord having a first end affixed to the first support body and having a second end affixed to the second support body, d. adjusting means for changing the horizontal position where said cord exits a top edge of the first and second support bodies, and e. adjusting means for changing a length of said cord exiting the top edge of the support bodies, wherein when the cord extending between the first and second side of the picture frame is hung on a wall hook, the picture may be positioned horizontally and vertically by changing the position where the cord exits the top edge of the first and second support bodies and by changing the length of the cord between the first and second support bodies.

7. A wall mounted support assembly for pictures, mirrors, and other similar objects, comprising:

a. a support body adapted to be affixed to a wall, said support body having top and bottom vertical lips, one vertical side lip and one open side edge, b. a cord adapted to be affixed on a first end to a first side of a picture frame, passing through a fixed aperture on the vertical side lip of said support body, continuing through the support body, exiting the open side edge of the support body and having a second end adapted to be affixed to a second side of the frame, c. adjusting means for changing a vertical position of the cord exiting the open side edge of the support body, and d. adjusting means for changing a length of the cord between the fixed ends to the sides of the support body, wherein a picture adapted to be attached to the cord ends may be positioned vertically and horizontally with respect to the wall.

8. A frame mounted support assembly for pictures, mirrors, and like objects, comprising:

a. a support body adapted to be affixed to a picture frame, said support body having top and bottom vertical lips, one vertical side lip and one open side edge, b. a cord adapted to be affixed on a first end to a first location on a wall, passing through a fixed aperture on the vertical side lip of said support body, continuing through the support body, exiting the open side edge of the support body and having a second end adapted to be affixed to a second location on a wall, c. adjusting means for changing a vertical position of the cord exiting the open side edge of the support body, and d. adjusting means for changing a length of the cord between the fixed ends to the sides of the support body, wherein a picture adapted to have the cord ends affixed to a wall may be positioned vertically and horizontally with respect to the wall.

* * * * *